US007198382B2

(12) United States Patent
Donovan

(10) Patent No.: US 7,198,382 B2
(45) Date of Patent: Apr. 3, 2007

(54) WAND WITH LIGHT SOURCES FOR READING OR VIEWING INDICIA

(76) Inventor: Louise D. Donovan, 17643, Myrtlewood Dr., Chesterfield, MO (US) 63005

( * ) Notice: Subject to any disclaimer, the term of this patent is extended or adjusted under 35 U.S.C. 154(b) by 179 days.

(21) Appl. No.: 10/672,605

(22) Filed: Sep. 26, 2003

(65) Prior Publication Data

US 2004/0062038 A1 Apr. 1, 2004

Related U.S. Application Data

(60) Provisional application No. 60/413,438, filed on Sep. 26, 2002.

(51) Int. Cl.
*F21L 4/02* (2006.01)
*F21V 33/00* (2006.01)

(52) U.S. Cl. ..... 362/184; 362/98; 362/234

(58) Field of Classification Search ..... 362/84, 362/98, 99, 184, 227, 228, 229, 231, 234, 362/246; 40/442, 443, 543; 434/157, 338
See application file for complete search history.

(56) References Cited

U.S. PATENT DOCUMENTS

| | | | | | |
|---|---|---|---|---|---|
| 2,699,620 | A * | 1/1955 | Smythe | 40/543 |
| 3,068,010 | A * | 12/1962 | Hagopian | 40/543 |
| 3,297,862 | A * | 1/1967 | Levy et al. | 362/99 |
| 4,249,234 | A * | 2/1981 | Park et al. | 362/228 |
| 4,604,065 | A | 8/1986 | Frazer et al. | |
| 4,627,819 | A | 12/1986 | Burrows | |
| 4,891,011 | A * | 1/1990 | Cook | 434/157 |
| 5,217,297 | A * | 6/1993 | Yuen | 362/184 |
| 5,695,218 | A | 12/1997 | Nicosia | |
| 6,174,078 | B1 * | 1/2001 | Ohm et al. | 362/228 |
| 6,979,104 | B2 * | 12/2005 | Brass et al. | 362/231 |

* cited by examiner

*Primary Examiner*—Y. My Quach-Lee
(74) *Attorney, Agent, or Firm*—Barnes & Thornburg LLP

(57) ABSTRACT

A wand configured to have two light sources capable of emitting light at different wavelengths to detect a plurality of indicia on a substrate such as a book. The wand and the substrate may be part of a kit.

5 Claims, 2 Drawing Sheets

WAND WITH LIGHT SOURCES FOR READING OR VIEWING INDICIA

CROSS-REFERENCE TO RELATED APPLICATIONS

This application claims priority to U.S. Ser. No. 60/413,438 filed Sep. 26, 2002.

BACKGROUND AND SUMMARY

The present disclosure relates to a wand with differential light sources that can reveal indicia on a substrate such as, for example, a book.

Glow-in-the dark books for children and other substrates with colored indicia are used as entertainment as well as teaching aids. The present disclosure is directed to a wand configured to have two light sources, the light sources capable of detecting a plurality of indicia on a substrate. The wand may be included as a kit that also includes any suitable substrate such as, for example, a book, playing cards, or other cards, puzzles, and board games. The kit may be suitable for use as a teaching aid, an entertainment or an amusement device.

BRIEF DESCRIPTION OF THE DRAWINGS

The drawings are provided to illustrate an embodiment of the disclosure. It is envisioned that alternate configurations of the embodiments of the present disclosure may be adopted without deviating from the disclosure as illustrated in these drawings and as described in the detailed description section below.

DETAILED DESCRIPTION

Figure 1:
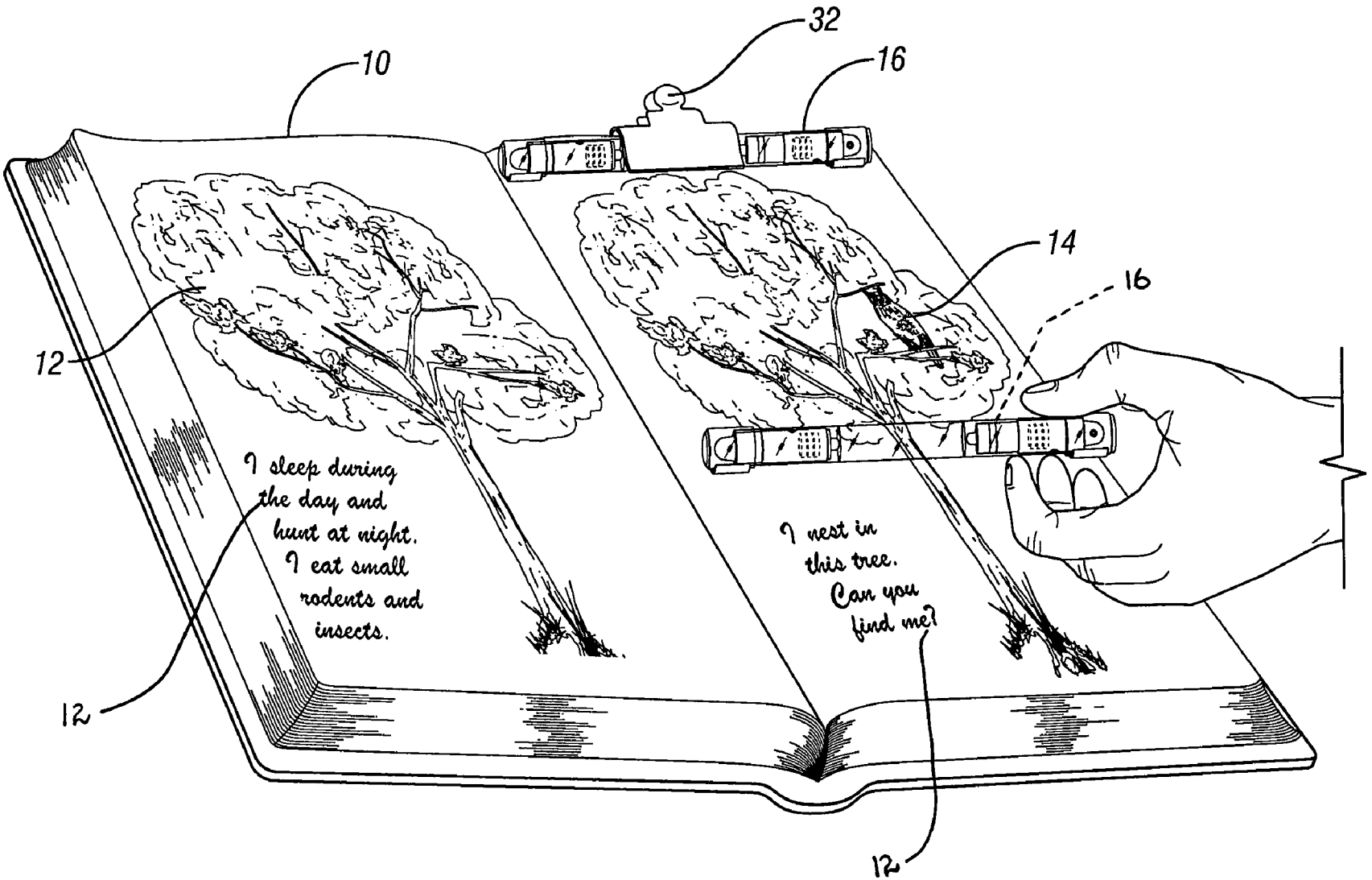
FIG. 1 is a perspective view of a kit in accordance with an embodiment of the present disclosure showing a wand of the kit removably secured to the substrate and also showing for illustrative purposes the wand removed for use.

While the concepts of the present disclosure are illustrated and described in detail in the drawings and the description below, such an illustration and description is to be considered as exemplary and not restrictive in character, it being understood that only the illustrative embodiments are shown and described and that all changes and modifications that come within the spirit of the disclosure are desired to be protected.

Figure 2:
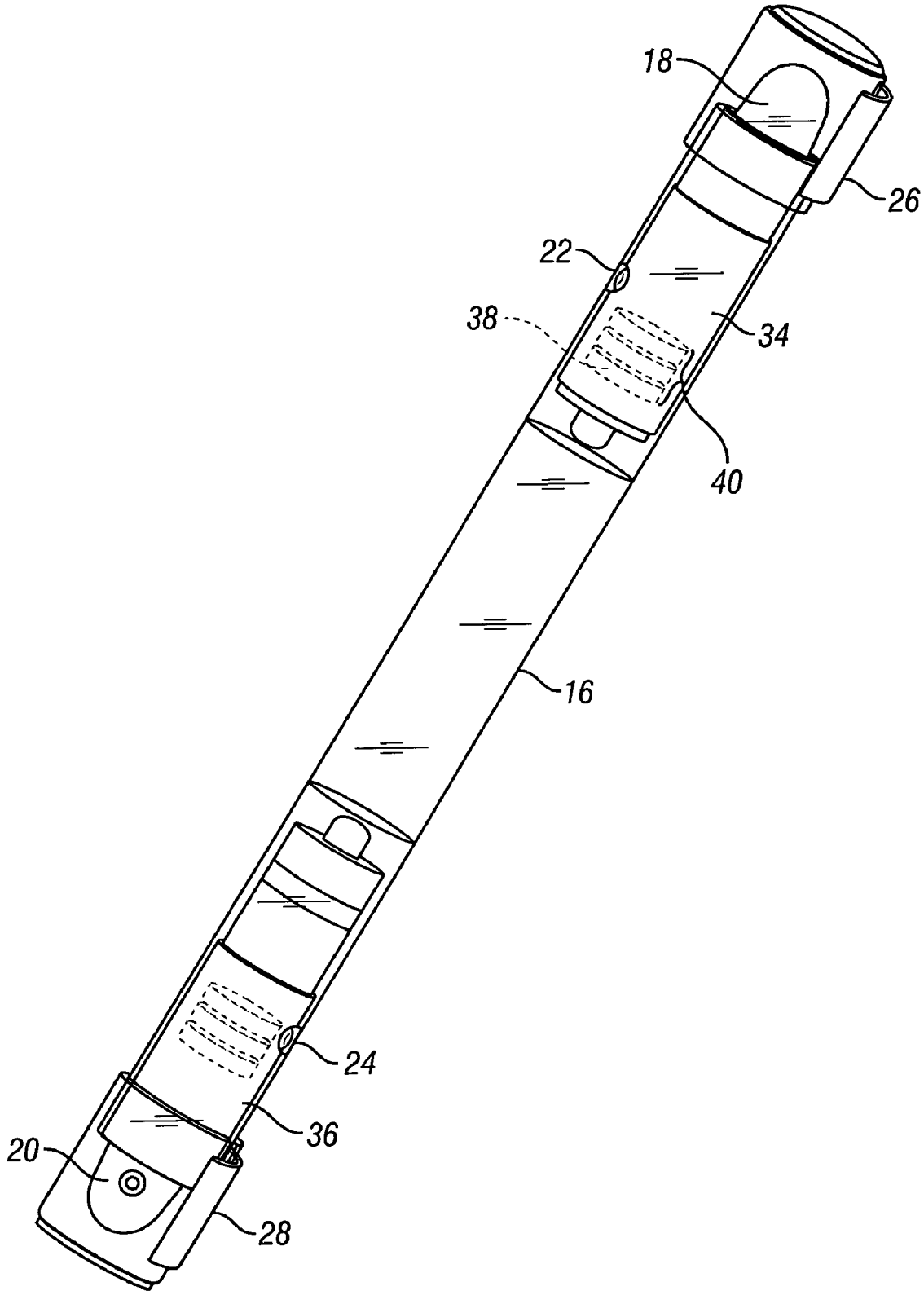
FIG. 2 is a perspective view of a wand of the kit of FIG. 1.

As shown in FIG. 1, a kit in accordance with an illustrative embodiment of the present disclosure includes a substrate 10 with a first indicia 12, a second indicia 14, and a wand 16. As shown in FIG. 2, the illustrated wand 16 includes a first light source 18 that emits visible light, for example white light, to reveal the first indicia 12 and a second light source 20 that emits long range ultraviolet (UV) light, for example, such as a black light, to make glow or otherwise reveal the second indicia 14. The illustrated substrate 10 constitutes a book. The substrate 10 may be in any other suitable form in accordance with other embodiments such as, for example, playing cards or other cards, board games, puzzles, fabric, and other printed material. The visible light from the wand 16 reveals the first indicia 12 to enable the book to be read in the dark, and the black light from the wand 16 reveals the second indicia 14 that is otherwise substantially concealed. FIG. 1 shows the wand 16 removably secured to the substrate 10 and for illustrative purposes shows the wand being used to reveal the second indicia 14.

The wand 16 may have any suitable configuration. In the illustrated embodiment, for example, the wand 16 includes at one end a first light source 18 that emits light in a visible spectrum of wavelength of about 700 nm and at the other end a second light source 20 that emits light in a long range ultraviolet spectrum of wavelength of about 345 nm and 400 nm. Either or both of the first and the second light sources 18 and 20 can be positioned elsewhere in the wand 16 in accordance with other embodiments such as, for example, at the same end of the wand 16 or towards the center of the wand 16. The first light source 18 may include a visible light emitting diode and the second light source 20 may include a black light emitting diode. Light sources that involve light emitting diodes (LEDs) can be obtained from LED manufacturers such as Ledtronics, Inc. Any other forms of light sources such as, for example, standard electrical bulbs or incandescent bulbs can also be used instead of LEDs. The wand 16 also has first and second controls 22 and 24, wherein the first control 22 activates and deactivates the first light source 18 and the second control 24 activates and deactivates the second light source 20. For example, the controls 22 and 24 may include on-off switches with optional bright-dim adjustments. The controls 22 and 24 may have any suitable construction or a single switch or control of any suitable construction may instead be used to activate and deactivate the first and second light sources 18 and 20 in accordance with other embodiments. The wand 16 further includes a first light diffuser 26 and a second light diffuser 28 to diffuse light from the first light source 18 and the second light source 20 respectively. These diffusers 26 and 28 are made of any suitable material such as, for example, sand-blasted plastic. Sand-blasted plastic may, for example, be manufactured by an electrical discharge machine that imparts sand-blasted finish to plastic. The light diffusers 26 and 28 may help to spread the light uniformly and also to filter any undesirable wavelength such as short-range ultraviolet light. Such light diffusers 26 and 28 can be obtained from standard optical filter manufacturers or lighting device manufacturers. In the illustrated embodiment, the wand 16 is a hollow cylinder made of plastic with partitions defining compartments for the first and second light sources 18 and 20, the controls 22 and 24, the diffusers 26 and 28, and the power sources 34 and 36 including batteries 38 and 40. The diffusers 26 and 28 may be secured to the cylinder by glue, molding, welding or any other suitable means. The wand 16 may have any other suitable construction and configuration in accordance with other embodiments. For example, the wand 16 be of the form of any suitable flash light with at least two different light sources. The wand 16 may also have any other form of shape or design such as, for example, circular or spherical construction.

The first and second indicia 12 and 14 may appear as any suitable matter. The first and second indicia 12 and 14 may, for example be images, pictures, letters, numbers, artwork, drawings, and animated drawings. In the illustrated embodiment, for example, the first indicia 12 comprises words and a tree, and the second indicia 14 is an owl in the tree. The second indicia 14 is not readily visible upon a cursory observation or is otherwise generally or substantially concealed until it is illuminated by the second light source 14 (see FIG. 1). The second indicia 14 is thus substantially or generally concealed under visible light source but is revealed under the ultraviolet light from the wand 16. The second indicia 14 may be drawn with an invisible ink, phosphorescent paints or inks or fluorescent paints or inks or other material capable of being illuminated by a black light or other source but visible light, can be purchased from craft stores, hardware or chemical stores.

The wand 16 may be operated by turning on the first light source 18 and moving the wand 16 over or adjacent the first indicia 12, for example, to enable reading or viewing the first indicia 12 in the dark, while the second indicia 14 remains substantially concealed. The first light source 18 may then be turned off with the first control 22 and the second light source 20 may be turned on with the second control 24. The second light source 20 may then be moved over or adjacent the second indicia 14 to reveal the second indicia 14. Thus in the illustrated embodiment, during darkness, the tree and words are revealed with the first light source 18, with the owl being substantially concealed under the first light source 18. The owl is revealed when exposed to the second light source 20. In a similar way, the wand 16 can also be used to reveal substantially concealed letters, words, phrases, and sentences. The wand 16 can also be used to reveal questions or clues to a riddle with the first light source 18 and the answers to the questions or riddles can be revealed using the second light source 20. By way of further example, the first indicia 12 may also include characters to form a question or a puzzle, and the second indicia 14 may include characters to form an answer to the question or the puzzle of the first indicia 12. The wand 16 can also be operated in a dark room, in a tent, outside at night, or other suitable environment.

The wand 16 may also have different colored light sources in accordance with other embodiments. For example, the first light source 18 may comprise a green color light and the second light source 20, in accordance with other embodiments, may comprise a red color light. Accordingly, if the first indicia 12 is green in color, it will be concealed under the green light source and will be visible under the red light source or visible light. Similarly, if the second indicia 14 is red in color, it will be concealed under the red light source and will be visible under the green light source or visible light. The wand 16 with different colored light sources may be operated in a dark room.

In the illustrated embodiment, the wand 16 is removably secured to the substrate 10 by a clip 32. The wand 16 may be attached to the book by any other suitable means such as, for example, Velcro™, a thread, wire, chain, or any other form of connector means. The wand 16 may also be held in the substrate in a suitable slot. The wand 16 may be removably secured to the substrate 10 at any suitable location on the substrate 10.

The wand 16 also includes any suitable power source. In the illustrated embodiment, for example, the wand 16 includes a first power source 34 and a second power source 36. The power source may include a single battery 38 or a plurality of batteries 40. A single power source 34 or 36 or a plurality of power sources 34 and 36 may supply power to the light sources 18 and 20. The batteries 38 and 40 may include standard batteries or watch batteries such as lithium ion batteries. The batteries 38 and 40 may also include rechargeable features. The power sources 34 and 36 for the wand may also include an external power supply such as an electrical outlet connected through an electrical cord. The power sources 34 and 36 including batteries 38 and 40 of appropriate size and strength can be purchased from standard hardware or electronics or electrical stores.

It will be noted that alternative embodiments of each of the apparatus, systems, and methods of the present disclosure may not include all of the features described yet still benefit from at least some of the inferred advantages of such features. Those of ordinary skill in the art may readily devise their own implementations of an apparatus, system, and method that incorporate one or more of the features of the present disclosure and fall within the spirit and scope of the disclosure.

I claim:

1. A kit comprising:

(a) a substrate comprising first indicia and second indicia, the first indicia being visible under a first light source and the second indicia being visible under a second ultraviolet radiation source;

(b) a wand comprising the first light source and the second ultraviolet radiation source, the first light source to illuminate the first indicia and the second ultraviolet radiation source to illuminate the second indicia;

(c) a first light diffuser and a second diffuser, the first light diffuser to diffuse light from the first light source and the second diffuser to diffuse radiation from the second ultraviolet source;

(d) a first and a second control, the first control to activate and deactivate the first light source and the second control to activate and deactivate the second ultraviolet source; and (e) a power source.

2. A kit comprising:

(a) a substrate comprising a first indicia and a second indicia, the first indicia being visible under a first light source and the second indicia being visible under a second ultraviolet radiation source; and (b) a wand comprising the first light source and the second ultraviolet radiation source, the first light source to illuminate the first indicia and the second ultraviolet radiation source to illuminate the second indicia, wherein the wand has first and second diffusers, the first diffuser to diffuse light from the first light source and the second diffuser to diffuse ultraviolet radiation from the second ultraviolet radiation source.

3. A kit comprising:

(a) a substrate comprising first indicia and a second indicia, the first indicia being visible under a first light source and the second indicia being visible under a second light source; and (b) a wand comprising the first light source and the second light source, the first light source to illuminate the first indicia and the second light source to illuminate the second indicia.

wherein the wand has first and second diffusers, the first light diffuser to diffuse light from the first light source and the second light diffuser to diffuse light from the second light source, wherein the first and second light diffusers are made of plastic.

4. The kit of claim 3, wherein the plastic is sand-blasted.

5. The kit of claim 4, wherein the plastic is sand-blasted through an electric discharge machine.

* * * * *